US006171219B1

(12) United States Patent
Simonson

(10) Patent No.: US 6,171,219 B1
(45) Date of Patent: Jan. 9, 2001

(54) CALF EXERCISE APPARATUS

(75) Inventor: Roy Simonson, Colorado Springs, CO (US)

(73) Assignee: The Simonson Family Limited Partnership, RLLLP, Colorado Springs, CO (US)

( * ) Notice: Under 35 U.S.C. 154(b), the term of this patent shall be extended for 0 days.

(21) Appl. No.: 09/437,316

(22) Filed: Nov. 10, 1999

Related U.S. Application Data

(63) Continuation-in-part of application No. 09/379,307, filed on Aug. 23, 1999.

(51) Int. Cl.[7] ..... A63B 23/035

(52) U.S. Cl. ..... 482/100; 482/79; 482/136; 482/139

(58) Field of Search ..... 482/52, 53, 57, 482/79, 80, 87, 100, 136, 137, 139

(56) References Cited

U.S. PATENT DOCUMENTS 4,511,137 * 4/1985 Jones ..... 482/100
4,600,188 * 7/1986 Bangerter et al. ..... 482/100
4,807,874 * 2/1989 Little ..... 482/100
5,449,332 * 9/1995 Hervig ..... 482/57

* cited by examiner

*Primary Examiner*—John Mulcahy
(74) *Attorney, Agent, or Firm*—Hoffman Wasson & Gitler PC

(57) ABSTRACT

An exercise apparatus including a base structure having a resistance assembly and a user support member is disclosed. The apparatus further includes a first user interface pivotally mounted to the base structure for rotation about a first axis at a position allowing an exerciser to comfortably sit upon the user support member, extend a leg and engage the first user interface. The first user interface includes a distal end to which a foot plate is secured and a central pivot which rotates about a second axis substantially perpendicular to the first axis. The apparatus also includes a cable linking the first user interface to the resistance assembly for the application of resistance as the user rotates the first user interface by extending a foot to exercise the user's calf muscle.

13 Claims, 4 Drawing Sheets

CALF EXERCISE APPARATUS

RELATED APPLICATION INFORMATION

This application is a continuation-in-part of U.S. patent application Ser. No. 09/379,307, filed Aug. 23, 1999, entitled "Exercise Apparatus", which is currently pending.

BACKGROUND OF THE INVENTION

1. Field of the Invention

The invention relates to an exercise apparatuses. More particularly, the invention relates to a calf and/or ankle exercise apparatus permitting flexibility in the natural rotation of a user's ankle.

2. Description of the Prior Art

While the muscles of the lower leg do not include the muscle mass of many larger muscle groups found throughout the human body, these muscles represent an important functional group for a variety of athletes ranging from sprinters to golfers. The muscles of the lower leg, and specifically, the calf, provide the power for vertical explosiveness needed by those athletes required to leap during competition or practice. The muscles of the lower leg, for example, the calf and those muscle associated with ankle rotation, contribute to the stability required to provide athletes with a strong foundation from which to work.

Exercise apparatuses have, therefore, been developed to exclusively focus on training these muscles with the hope of improving an athlete's performance and reducing the occurrence of injuries. These exercise apparatuses generally require a user to engage a user interface with his or her foot, rotate the interface against a resistance force. The interface is commonly constructed to isolate the rotation of the ankle for movement either laterally or in-line with the sagittal plane. Some interfaces even allow for movement about multiple axis.

Despite the efforts to replicate the natural movement of an individual's ankle during exercise, the prior art apparatuses have failed to provide a convenient, cost effective and useful apparatus which replicates the expansion and contraction of the calf muscle while also providing for the supination and pronation of an individual's ankle. The present invention provides such an apparatus.

SUMMARY OF THE INVENTION

It is, therefore, an object of the present invention to provide an exercise apparatus including a base structure having a resistance assembly and a user support member. The apparatus further includes a first user interface pivotally mounted to the base structure for rotation about a first axis at a position allowing an exerciser to comfortably sit upon the user support member, extend a leg and engage the first user interface. The first user interface includes a distal end to which a foot plate is secured and a central pivot which rotates about a second axis substantially perpendicular to the first axis. The apparatus also includes a cable linking the first user interface to the resistance assembly for the application of resistance as the user rotates the first user interface by extending a foot to exercise the user's calf muscle.

It is also an object of the present invention to provide an exercise apparatus including a second user interface substantially identical to the user interface disclosed above.

It is another object of the present invention to provide an exercise apparatus wherein the first axis of the second user interface is substantially aligned with the first axis of the first user interface.

It is a further object of the present invention to provide an exercise apparatus wherein the first axis of the first user interface lies in a substantially horizontal plane.

It is also another object of the present invention to provide an exercise apparatus wherein the second axis of the second user interface lies substantially parallel to the second axis of the second user interface.

It is yet another object of the present invention to provide an exercise apparatus wherein a single cable links both the first user interface and the second user interface to the resistance assembly.

It is still a further object of the present invention to provide an exercise apparatus wherein the second user interface includes a first section pivotally mounted on the base structure in a manner defining the first axis and a second section pivotally coupled to the first section in a manner defining the second axis.

It is also an object of the present invention to provide an exercise apparatus wherein the cable is secured to the first section of the second user interface.

It is another object of the present invention to provide an exercise apparatus wherein the resistance assembly is a weight stack.

It is a further object of the present invention to provide an exercise apparatus wherein the user support member is adjustably supported on the base structure.

Other objects and advantages of the present invention will become apparent from the following detailed description when viewed in conjunction with the accompanying drawings, which set forth certain embodiments of the invention.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
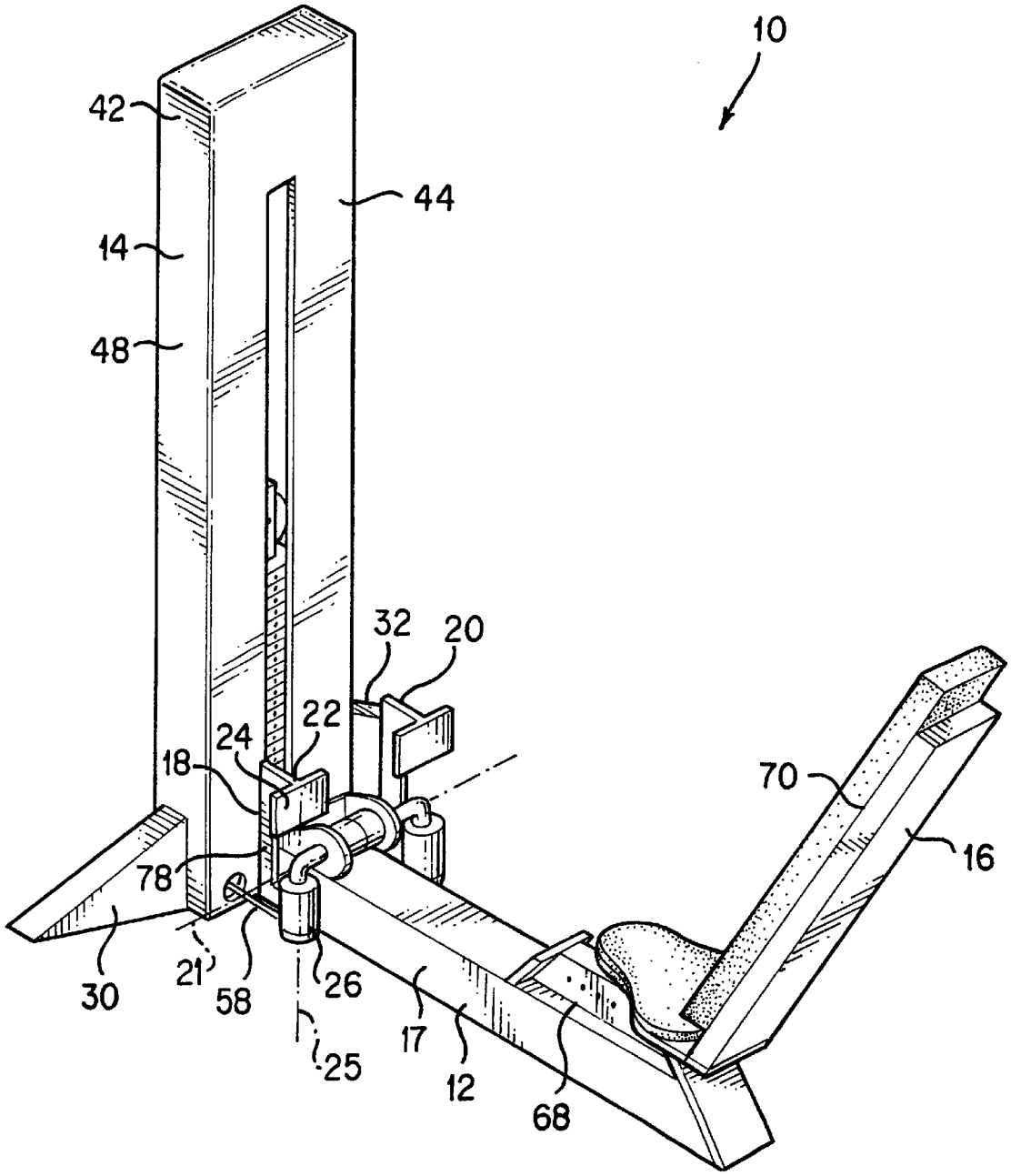
FIG. 1 is a perspective view of the exercise apparatus in accordance with the present invention.
Figure 3:
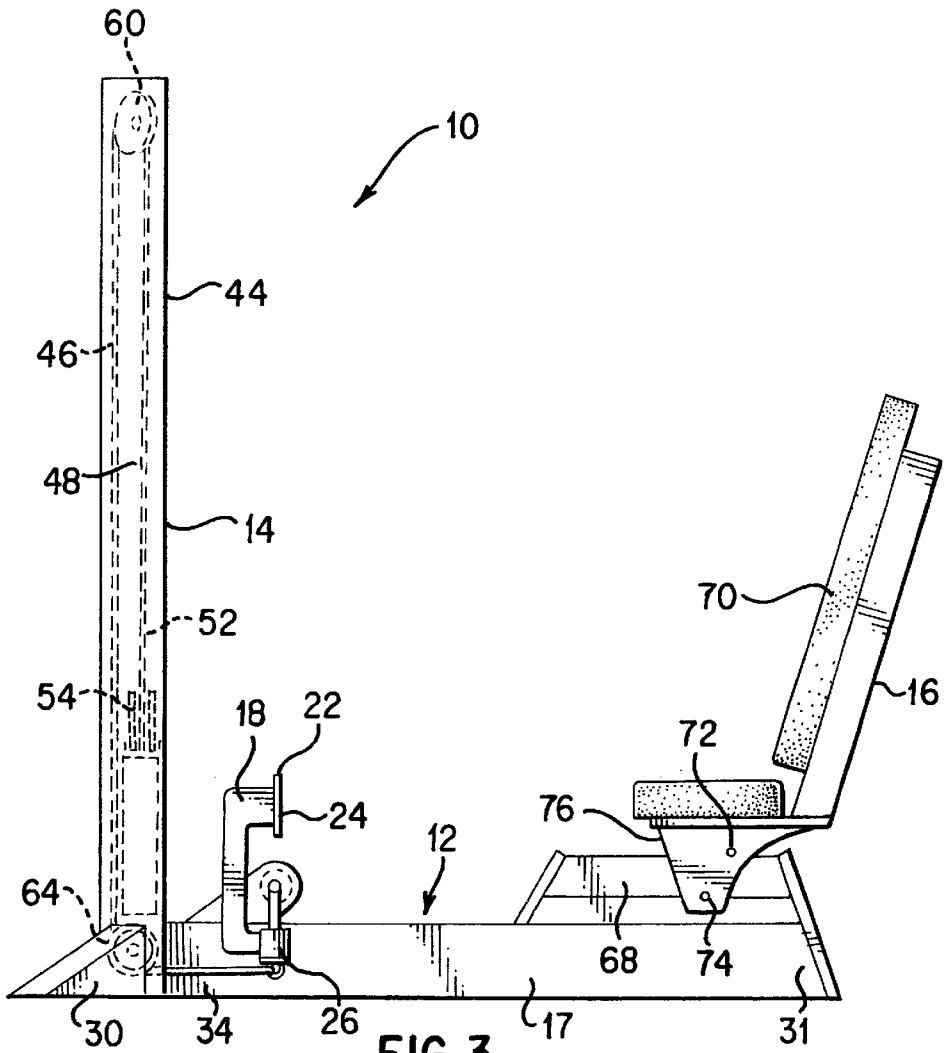
FIG. 3 is a side view of the exercise apparatus shown in FIG. 1.
Figure 2:
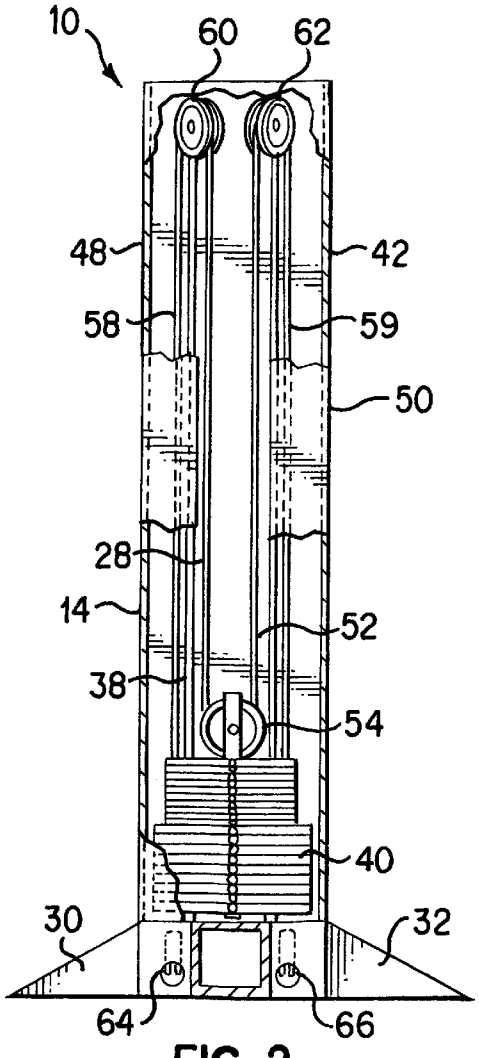
FIG. 2 is a partial cross sectional view of the internal structure of the weight stack.
Figure 4:
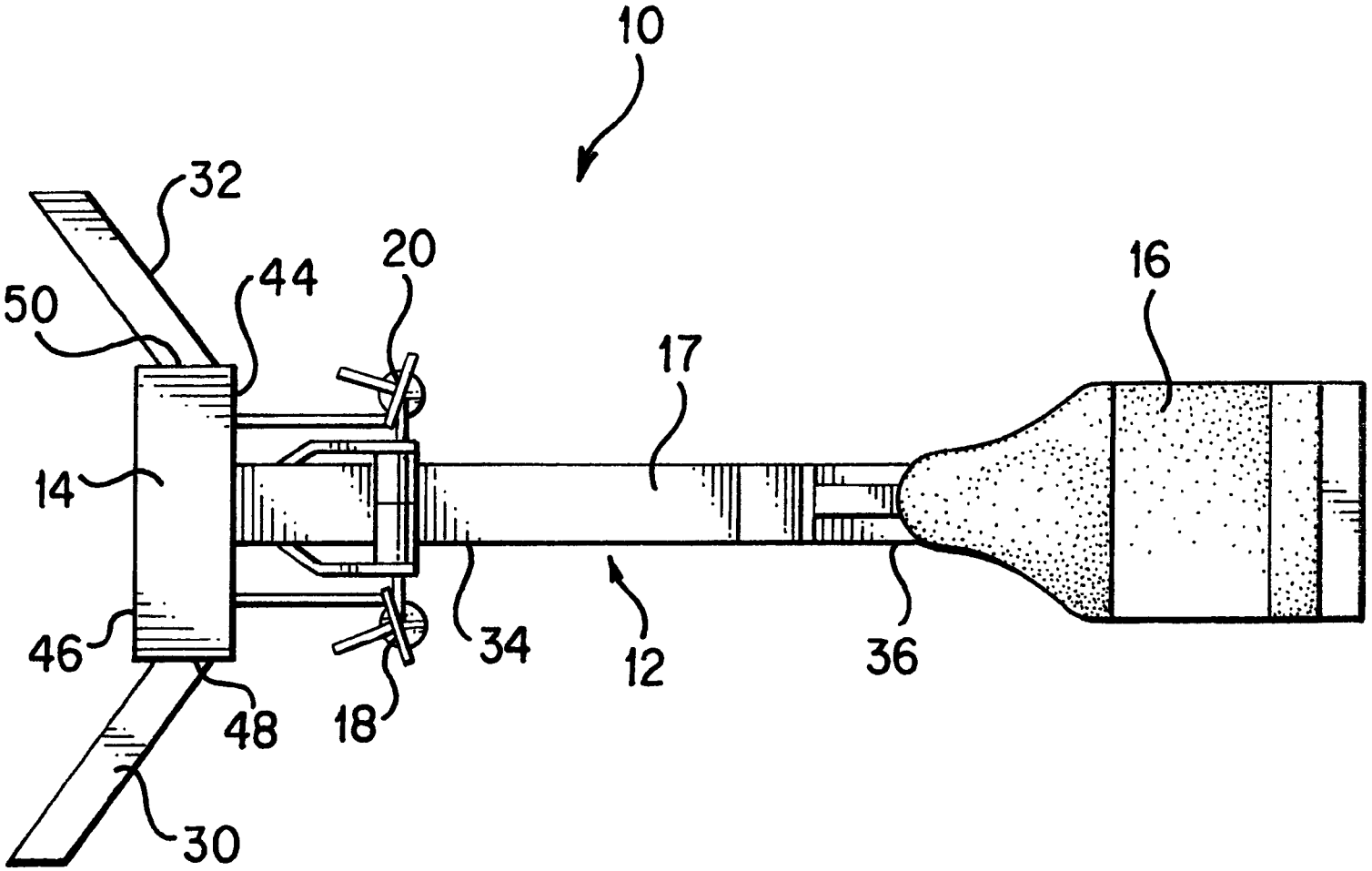
FIG. 4 is a top view of the exercise apparatus shown in FIG. 1.
Figure 5:
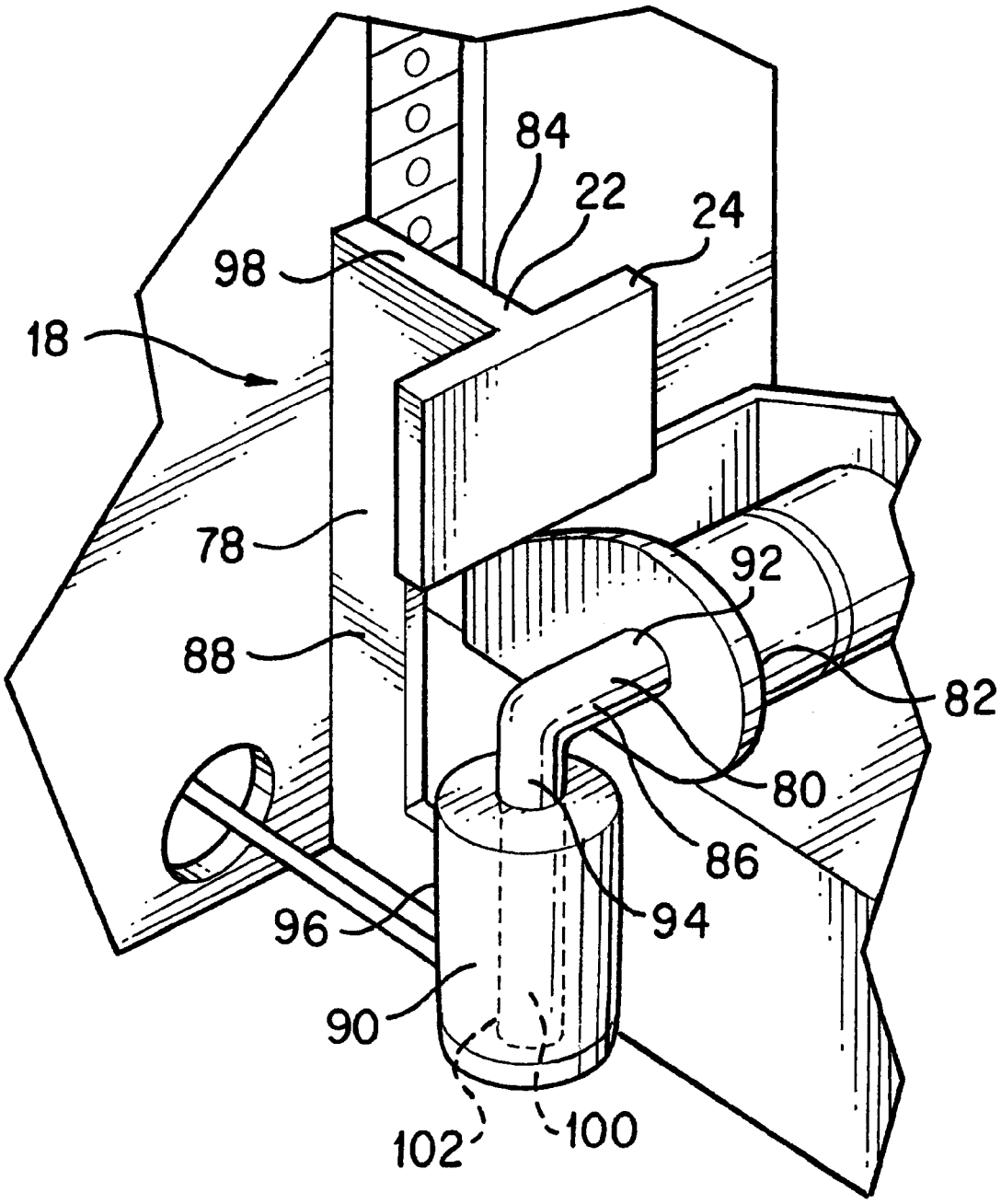
FIG. 5 is a detailed perspective view of the user interface.

With reference to FIGS. 1 through 5, a calf exercise apparatus 10 is disclosed. The calf exercise apparatus 10 includes a base structure 12 having a resistance assembly 14 and a user support member 16, or seat assembly connected by a central support member 17. The calf exercise apparatus 10 further includes first and second user interfaces 18, 20 pivotally mounted to the base structure 12 for rotation about a first axis 21 as the user flexes his or her foot toward the resistance assembly 14. The first and second user interfaces 18, 20 are positioned to allow an exerciser to comfortably sit upon the user support member 16, extend a leg and engage the user interfaces 18, 20.

Each user interface 18, 20 includes a distal end 22 to which a foot plate 24 is secured and a central pivot 26 which rotates about a second axis 25 substantially perpendicular to and coplanar with the first axis 21. A single cable 28 links the first and second user interfaces 18, 20 to the resistance assembly 14 for the application of resistance as the user rotates the user interfaces 18, 20 by extending his or her feet to exercise the user's calf muscles.

The central support member 17 is preferably a tubular member with a rectangular cross section. The central support member 17 is formed from steel, although those skilled in the art will appreciate the other materials which may be used in the construction of the disclosed exercise apparatus without departing from the spirit of the present invention.

First and second lateral support members 30, 32 are also secured to the second end 34 of the central support member 17. The lateral support members 30, 32 extend outwardly from the longitudinal axis of the central support member 17 and away from the first end 36 of the central support member 17. The combination of the cental support member 17, the first lateral support 30 and the second lateral support 32 create a tripod foundation structure. This foundation structure supports the remaining components of the present exercise apparatus, as well as users of the present exercise apparatus.

In accordance with a preferred embodiment of the present invention, the resistance assembly 14 is a conventional weight stack. The weight stack 14 is secured to the second end 34 of the central support member 17 and includes vertical support members 38 aligned to support a stack of weight plates 40 to be moved via a pulley system discussed below in greater detail. The weight stack 14 is covered by a protective sleeve 42 positioned about the weight stack 14. The weight stack 14 is vertically oriented and includes a front face 44, a rear face 46, a left side 48 and a right side 50.

As will be discussed below in substantially greater detail, the weight stack 14 is actuated by a single cable 28 which controls the movement of the stack of weight plates 40.

The central portion 52 of the cable 28 is passed through a first pulley 54. A coupling member 56 directly couples the stack of weight plates 40 to the first pulley 54 in a conventional manner.

Opposite strands 58, 59 of the cable 28 then respectively extend over first and second upper pulleys 60, 62 before being directed downwardly and passing over first and second lower pulleys 64, 66.

After passing over the first and second lower pulleys 64, 66 the first and second strands 58, 59 are directed out the front face 44 of the weight stack 14 for engagement by the user.

The respective ends of the first and second strands 58, 59 are finally coupled to pivoting user interfaces 18, 20.

The user support member 16 is a conventional seat supported at the first end 36 of the central support member 17. Specifically, the user support member 16 includes a rail 68 directly secured to the central support member 17. A complete seat 70 with a backrest is mounted on the rail 68 for selective movement along the rail 68. Movement of the seat 70 along the rail 68 is controlled by first and second restraint members 72, 74 secured to downwardly extending flanges 76 on the base of the seat 70. The first and second restraint members 72, 74 grip the rail 68 to securely hold the seat 70 in position when the seat 70 is its use position. However, when the seat 70 is slightly rotated toward the weight stack 14, the first and second restraint members 72, 74 release the rail 68 permitting the seat 70 to be freely moved along the rail 68.

As briefly discussed above, the calf exercise apparatus 10 includes first and second pivoting user interfaces 18, 20. The first and second pivoting user interfaces 18, 20 are mirror images of each other, and will be described with reference to only the first pivoting user interface 18. The first pivoting user interface 18 is pivotally mounted to the base structure 12 for rotation about a first axis 21 at a position allowing an exerciser to comfortably sit upon the user support member and engage the first user interface.

Specifically, the first user interface includes a pivot bar 78 having a first end 80 pivotally mounted to a support flange 82 affixed to the central support member 17. The pivot bar 78 also includes a free second end 84 with a foot plate 24 secured thereto. The foot plate 24 is positioned to face the seat 70 such that a user may sit upon the seat 70, extend a leg and place the sole of his or her foot directly upon the foot plate 24.

The pivot bar 78 is composed of a first section 86 and a second section 88 which are pivotally coupled at a central section 90 of the pivot bar 78. Specifically, the first section 86 includes a first end 92 pivotally coupled to the support flange 82 and a second end 94 pivotally coupled to the second section 88. The second section 88 includes a first end 96 pivotally coupled to the second end 94 of the first section 86 and a second end 98 to which the foot plate 24 is coupled.

With this in mind, the second end 94 of the first section 86 is formed with a pivot post 100 shaped and dimension for placement within a pivot ring 102 formed at the first end 96 of the second section 88. The pivot post 100 includes a longitudinal axis extending substantially perpendicular to the first axis 21 about which the pivot rotates relative to the support flange 82 when the user flexes his or her foot toward the weight stack 14. As a result, the second section 88 rotates relative to the first section 86 about a second axis 25 which is substantially perpendicular to the first axis 21 about which the pivot bar 78 rotates relative to the support flange 82.

The foot plate 24 is mounted on the second end 98 of the second section 88 such that a user may place the sole of his or her foot, specifically, the ball of the foot, upon the foot plate 24 with the user's ankle lying at the intersection of the first axis 21 and the second axis 25. By positioning the user's foot in this way, the first axis 21 provides for the forward flexing of the ankle to exercise the calf of the user. The second axis 25 provides for lateral rotation of the ankle, that is, pronation and supination, while the user moves through his or her exercise routine.

As discussed above, the first and second user interface members 18, 20 are mirror images. The first axis of the second user interface 20 is, therefore, aligned with the first axis of the first user interface 18. The second axis of the second user interface 20 is substantially parallel to the second axis of the first user interface 18. The orientation of the axes in this way allows the user to sit on the seat and simultaneously exercise both the left and right calves.

A single cable 28 links the first and second user interfaces 18, 20 to the weight plates 40 stored within the weight stack 14. Specifically, after exiting the weight stack 14, the distal ends of the first and second strands 58, 59 are respectively coupled to the first and second user interfaces 18, 20. The ends of the first and second strands 18, 20 are specifically secured to the first section 86 adjacent its second end 94. In this way, the cable 28, and ultimately the weight plates 40 provide resistance to the forward flexing of the exerciser's ankle while allowing the exerciser's ankle to freely flex to the left or right.

In use, an individual will sit upon the seat 70, extend his or her legs and place the ball of each foot on respective foot plates 24 of the first and second user interface members 18, 20. The exerciser's feet should be placed such that his or her ankle is positioned substantially at the intersection of the first and second axes. The exerciser then works through an exercise routine by flexing his or her feet forward to exercise the calf muscles.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. An exercise apparatus, comprising:

a base structure including a resistance assembly and a user support member;

a first user interface pivotally mounted to the base structure for rotation about a first axis at a position allowing an exerciser to comfortably sit upon the user support member, extend a leg and engage the first user interface, the first user interface includes a distal end to which a foot plate is secured, and the first user interface further includes a central pivot which rotates about a second axis substantially perpendicular to and coplanar with the first axis, wherein the second axis is positioned along the first user interface to permit pivoting of the foot plate about both the first axis and the second axes; and a cable linking the first user interface to the resistance assembly for the application of resistance as the user rotates the first user interface by extending a foot to exercise the user's calf muscle.

2. The exercise apparatus according to claim 1, further including a second user interface pivotally mounted to the base structure opposite the first user interface for rotation about a first axis at a position allowing an exerciser to comfortably sit upon the user support member, extend a leg and engage the second user interface, the second user interface includes a distal end to which a foot plate is secured, and the second user interface further includes a central pivot which rotates about a second axis substantially perpendicular to the first axis, wherein the second axis is positioned along the second user interface to permit pivoting of the foot plate about both the first axis and the second axes; and the cable links the second user interface to the resistance assembly for the application of resistance as the user rotates the second user interface by extending a foot to exercise the user's calf muscle.

3. The exercise apparatus according to claim 2, wherein the first axis of the second user interface is substantially aligned with the first axis of the first user interface.

4. The exercise apparatus according to claim 3, wherein the first axis of the first user interface lies in a substantially horizontal plane.

5. The exercise apparatus according to claim 3, wherein the second axis of the first user interface lies substantially parallel to the second axis of the second user interface.

6. The exercise apparatus according to claim 2, wherein a single cable links both the first user interface and the second user interface to the resistance assembly.

7. The exercise apparatus according to claim 2, wherein the second user interface includes a first section pivotally mounted on the base structure in a manner defining the first axis and a second section pivotally coupled to the first section in a manner defining the second axis.

8. The exercise apparatus according to claim 7, wherein the cable is secured to the first section of the second user interface.

9. The exercise apparatus according to claim 1, wherein the resistance assembly is a weight stack.

10. The exercise apparatus according to claim 1, wherein the user support member is adjustably supported on the base structure.

11. The exercise apparatus according to claim 1, wherein the first user interface includes a first section pivotally mounted on the base structure in a manner defining the first axis and a second section pivotally coupled to the first section in a manner defining the second axis.

12. The exercise apparatus according to claim 11, wherein the cable is secured to the first section of the first user interface.

13. The exercise apparatus according to claim 1, wherein the first axis lies in a substantially horizontal plane.

* * * * *

UNITED STATES PATENT AND TRADEMARK OFFICE

CERTIFICATE OF CORRECTION

PATENT NO. : 6,171,219 B1
DATED : January 9, 2001
INVENTOR(S) : Roy Simonson

It is certified that error appears in the above-identified patent and that said Letters Patent is hereby corrected as shown below:

Title page,
Item [73], Assignee, change "The Simonson Family Limited Partnership, RLLLP" to -- Ground Zero Design Corporation --

Column 1,
Line 5, change "09/379,.307" to -- 09/379,307 --
Line 6, after "pending", insert a period
Line 11, after "to", delete "an"
Line 24, change "muscle" to -- muscles --
Line 31, after "foot,", insert -- and --
Line 36, change "axis" to -- axes --
Line 53, after "leg", insert a comma Column 2,
Line 7, change "second" to -- first --

Column 3,
Line 65, after "is", insert -- in --

Column 4,
Line 29, change "dimension" to -- dimensioned --

Signed and Sealed this

Twenty-fifth Day of June, 2002

*Attest:*

*Attesting Officer*

JAMES E. ROGAN
*Director of the United States Patent and Trademark Office*